US008523611B2

(12) United States Patent
Pan et al.

(10) Patent No.: US 8,523,611 B2
(45) Date of Patent: Sep. 3, 2013

(54) ELECTRICAL CONNECTOR HAVING CONTACT MODULES WITH DIFFERENTIAL PAIRS ON BOTH SIDES OF A PRINTED CIRCUIT BOARD

(75) Inventors: Feng Pan, Kunshan (CN); Chun-Hsiung Hsu, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/423,609

(22) Filed: Mar. 19, 2012

(65) Prior Publication Data

US 2012/0238139 A1 Sep. 20, 2012

(51) Int. Cl.
*H01R 13/66* (2006.01)

(52) U.S. Cl.
USPC ..... 439/620.22

(58) Field of Classification Search
USPC ..... 439/79, 80, 108, 607.23, 620.22
See application file for complete search history.

(56) References Cited

U.S. PATENT DOCUMENTS

| | | | | |
|---|---|---|---|---|
| 4,871,321 | A | 10/1989 | Johnson | |
| 5,725,386 | A * | 3/1998 | Davis et al. | 439/79 |
| 6,109,935 | A * | 8/2000 | Yang | 439/80 |
| 6,663,415 | B1 | 12/2003 | Wu | |
| 6,899,566 | B2 | 5/2005 | Kline | |
| 7,717,745 | B2 * | 5/2010 | He et al. | 439/607.23 |
| 7,887,371 | B2 * | 2/2011 | Kenny et al. | 439/620.22 |
| 8,033,841 | B2 * | 10/2011 | He | 439/108 |
| 8,062,070 | B2 * | 11/2011 | Jeon et al. | 439/620.22 |
| 8,123,563 | B2 * | 2/2012 | Kenny et al. | 439/620.22 |

FOREIGN PATENT DOCUMENTS

WO 86/06556 11/1986

* cited by examiner

*Primary Examiner* — Chandrika Prasad
(74) *Attorney, Agent, or Firm* — Ming Chieh Chang; Wei Te Chung

(57) ABSTRACT

An electrical connector comprises a printed circuit board (12) having a rear edge connected to the cable (10) and a front edge opposite to the rear edge, a number of upper contact modules (21) stacked along the front edge on a top side (122) of the printed circuit board (12), and a number of lower contact modules (22) stacked along the front edge on a bottom side 124 of the printed circuit board (12). Each of the contact modules (21, 22) has a conductor pairs (14) for transferring signal differential pairs lined along a column direction perpendicular to the printed circuit board (12) and an insulator (152, 156) encapsulating a portion of each conductor (14) of the conductor pairs.

20 Claims, 8 Drawing Sheets

ELECTRICAL CONNECTOR HAVING CONTACT MODULES WITH DIFFERENTIAL PAIRS ON BOTH SIDES OF A PRINTED CIRCUIT BOARD

BACKGROUND OF THE INVENTION

1. Field of the Invention

The present invention relates to an electrical connector of high density with lower profile.

2. Description of Related Art

U.S. Pat. No. 6,899,566, issued to Kline et al. on May 31, 2005, discloses a backplane connector mounted on one side of a daughter card. However, there is no disclosure about how to arrange the connector on both sides of the daughter card to achieve a low profile.

U.S. Pat. No. 4,871,321, issued to Johnson et al. on Oct. 3, 1989, discloses a backplane connector in which contact pins extending from separate portions thereof are adapted to enter a circuit board from both sides. The connector has two connector portions mounted on opposite sides of a daughter card. However, a pair of pins are used to latch the two connector portions which increases the profile of the connector.

U.S. Pat. No. 6,663,415, issued to Wu on Dec. 16, 2003, discloses a high speed cable assembly in which two rows of contacts define a slot receiving a printed circuit board. However, the contact density is very limited.

Additionally, the contacts disclosed in latter two prior art references are prone to damage since the contacts are exposed to outside during most of the manufacturing processes of the connector.

SUMMARY OF THE INVENTION

An object of the present invention is to provide a cable assembly comprising a cable and an electrical connector connected to an end of the cable. The electrical connector further comprises a printed circuit board having a rear edge connected to the cable and a front edge opposite to the rear edge, a plurality of upper contact modules stacked along the front edge on a top side of the printed circuit board, and a plurality of lower contact modules stacked along the front edge on a bottom side of the printed circuit board. Each of the upper contact modules has at least one first conductor pairs for transferring signal differential pairs lined along a column perpendicular to the printed circuit board and a first insulator encapsulating a center portion of each first conductor of the first conductor pairs. Each first conductor of the first conductor pairs further comprises a front portion for mating with a complementary connector and a rear portion mounted onto the printed circuit board. Each of the lower contact modules has a plurality second conductor pairs for transferring signal differential pairs lined along a column perpendicular to the printed circuit board and a second insulator encapsulating a center portion of each second conductor of the second conductor pairs. Each second conductor of the second conductor pairs further comprises a front portion for mating with the same complementary connector and a rear portion mounted onto the printed circuit board.

Another object of the present invention is to provide an electrical connector comprising a printed circuit board, a plurality of stacked upper contact modules mounted on a top side of the printed circuit board, and a plurality of stacked upper contact modules mounted on a bottom side of the printed circuit board. The printed circuit board has a front edge defining a plurality of first plated through holes disposed in a rear area and a plurality of second plated through holes disposed in a front area. Each of the upper contact modules has at least one first conductor pairs for transferring signal differential pairs lined along a column perpendicular to the printed circuit board and a first insulator encapsulating a center portion of each first conductor of the first conductor pairs. Each first conductor of the first conductor pairs further comprises a front portion for mating with a complementary connector and a rear portion mounted into corresponding first plated through hole of the printed circuit board. Each of the lower contact modules has at least one second conductor pairs for transferring signal differential pairs lined along a column perpendicular to the printed circuit board and a second insulator encapsulating a center portion of each second conductor of the second conductor pairs. Each second conductor of the second conductor pairs further comprises a front portion for mating with the same complementary connector and a rear portion mounted into corresponding second plated through hole of the printed circuit board.

Since the contact modules are disposed on opposite sides of the printed circuit board, the height of the electrical connector could be lowered and the space on opposite side of the printed circuit board is fully used to receive the conductor pairs and the cable end soldered onto the printed circuit board. Furthermore, the qualified impedance of the conductor pairs is easier to obtained since the rear portions of the conductor pair are disposed one adjacent to the other.

Other objects, advantages and novel features of the invention will become more apparent from the following detailed description of a preferred embodiment when taken in conjunction with the accompanying drawings.

DETAILED DESCRIPTION OF THE INVENTION

Figure 1:
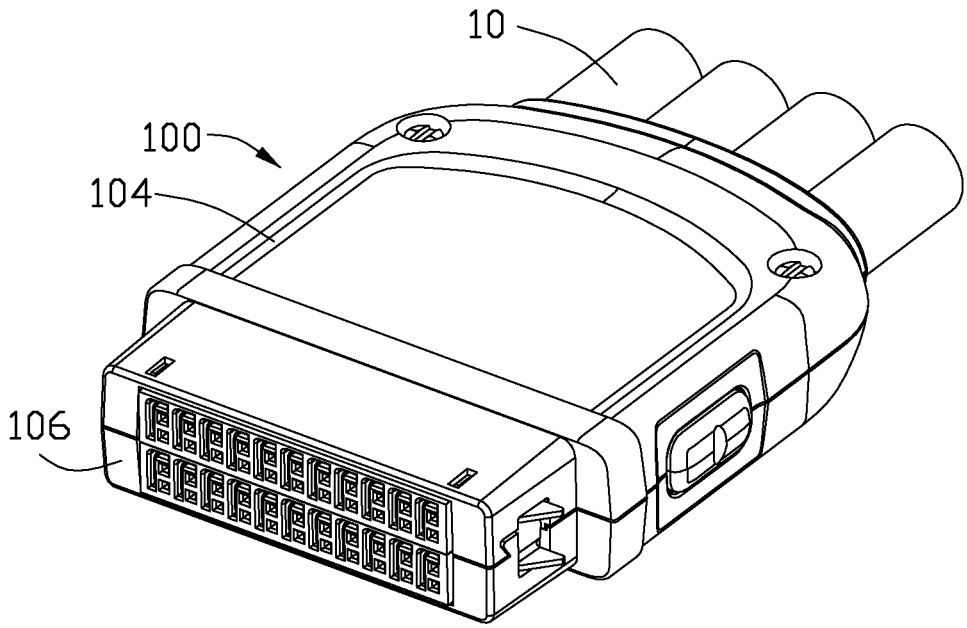
FIG. 1 is a perspective view of a cable assembly according to an embodiment of the present invention.
Figure 2:
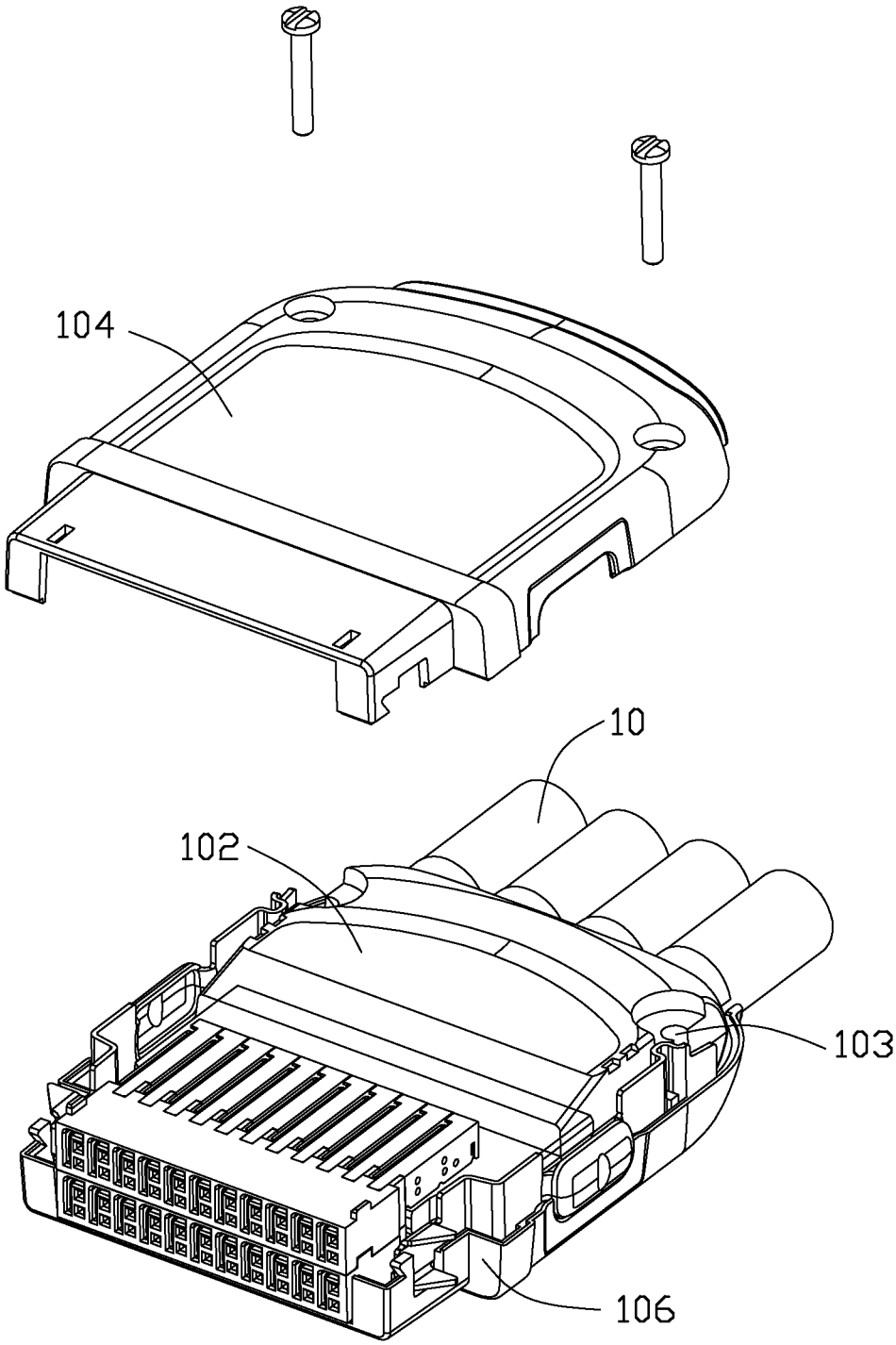
FIG. 2 is a perspective view of the cable assembly shown in FIG. 1 except that a top conductive cover is removed away.
Figure 3:
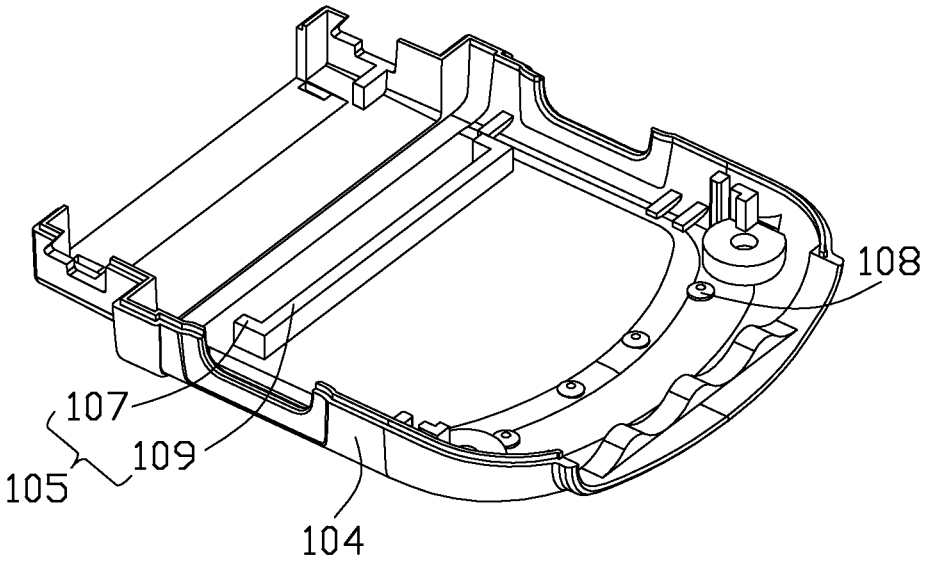
FIG. 3 is a bottom perspective view of the top conductive cover shown in FIG. 2.

Reference will now be made to the drawing figures to describe the present invention in detail.

Referring to FIG. 1, a cable assembly 100 comprises a cable 10 and an electrical connector connected to an end of the cable 10.

Referring to FIGS. 2-5, the electrical connector further comprises a printed circuit board 12 having a rear edge connected to the cable 10 and a front edge opposite to the rear edge, a plurality of upper contact modules 21 stacked along the front edge on a top side 122 of the printed circuit board 12, and a plurality of lower contact modules 22 stacked along the front edge on a bottom side 124 of the printed circuit board 12. The cable 10 has a plurality of conductors (not shown) soldered onto opposite sides of the printed circuit board 12, and then the soldered portions are over-molded with a protecting insulator 102. Each of the upper contact modules 21 has a first conductor pairs 141, 142 for transferring signal differential pairs lined along a column perpendicular to the printed circuit board 12 and a first insulator 152 encapsulating a center portion of each first conductor of the first conductor pairs 141, 142. Each first conductor 141, 142 further comprises a front portion for mating with a complementary connector (not shown) and a rear portion 146 mounted onto the printed circuit board 12. Each of the lower contact modules 22 has a second conductor pairs 143, 144 for transferring signal differential pairs lined along a column perpendicular to the printed circuit board 12 and a second insulator 156 encapsulating a center portion of each second conductor 143, 144 of the second conductor pairs. Each second conductor 143, 144 further comprising a front portion for mating with the complementary connector and a rear portion 146 mounted onto the printed circuit board 12.

Figure 5:
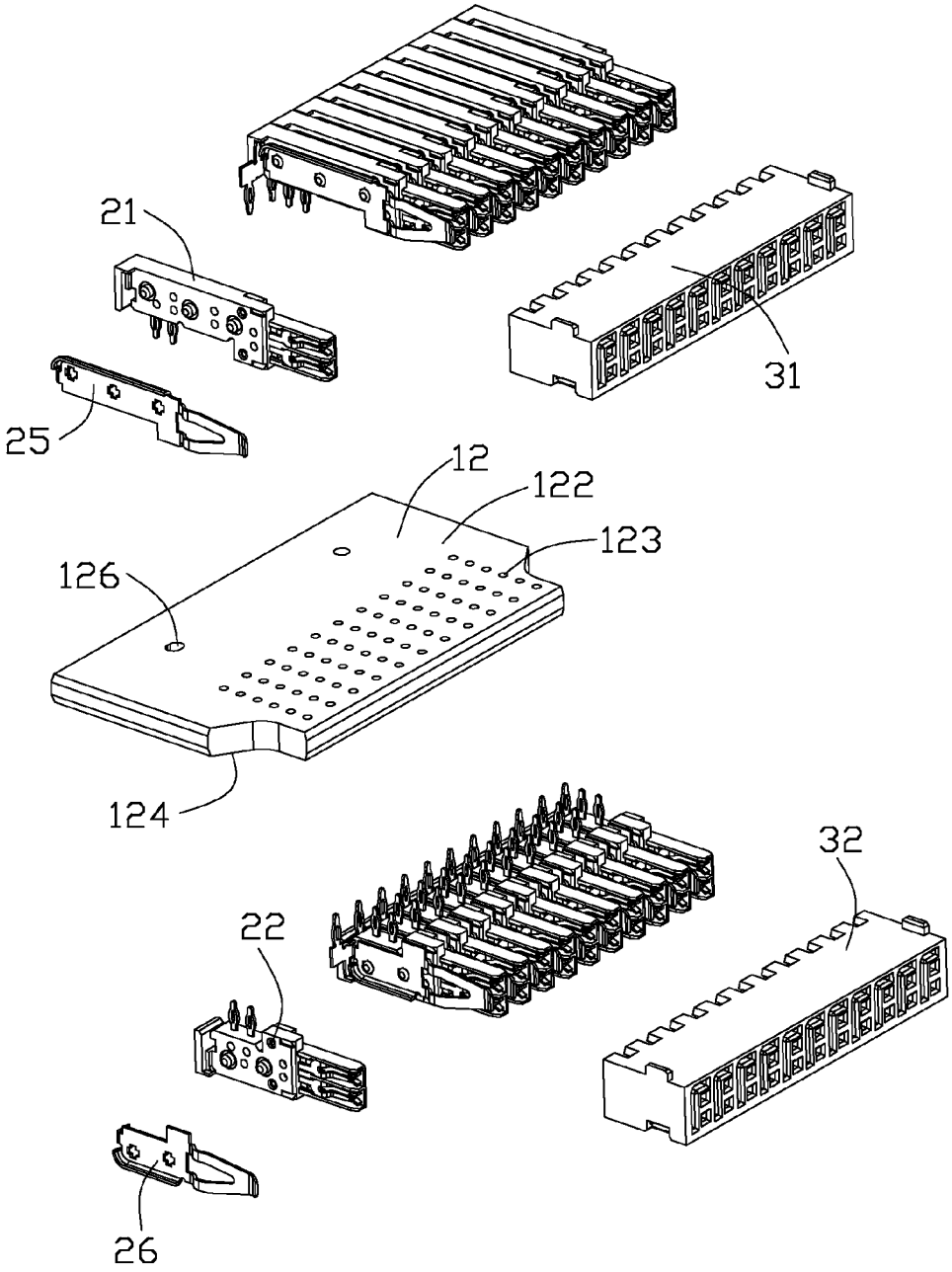
FIG. 5 is an exploded view of the subassembly shown in FIG. 4.
Figure 6:
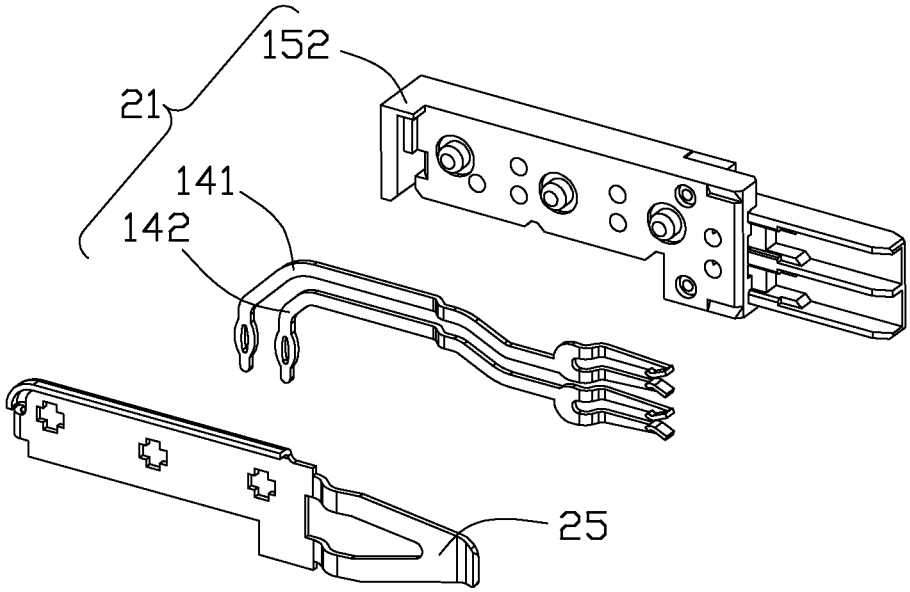
FIG. 6 is an exploded view of an upper contact module and an adjacent conductive plate with shown in FIG. 5.
Figure 7:
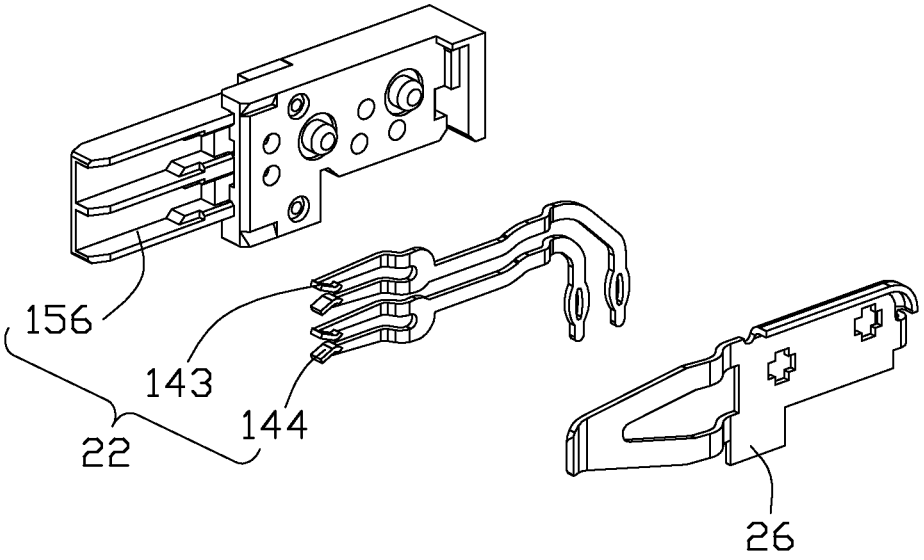
FIG. 7 is an exploded view of a lower contact module and an adjacent conductive plate with shown in FIG. 5.

Referring to FIGS. 5-7, the electrical connector further comprises a first front housing 31 and a second front housing 32. The first front housing 31 receives the front portions of the first conductors 141, 142 of each upper contact modules and engages with the first insulators 152. The second front housing 32 receives the front portions of the second conductors 143, 144 of each lower contact modules 22 and engages with the second insulators 156. The electrical connector further comprises a plurality of conductive plates 25, 26 adjacent each upper contact module 21 and lower contact module 22. Each of the conductive plates 25, 26 has a plurality of front portions (not labeled) for mating with the complementary connector. The insulator 152, 156 of each contact module 21, 22 defines a recess (not labeled) to receiving the adjacent conductive plate 25, 26 and the conductive plate 25, 26 is fixed to said contact module 21, 22.

Figure 4:
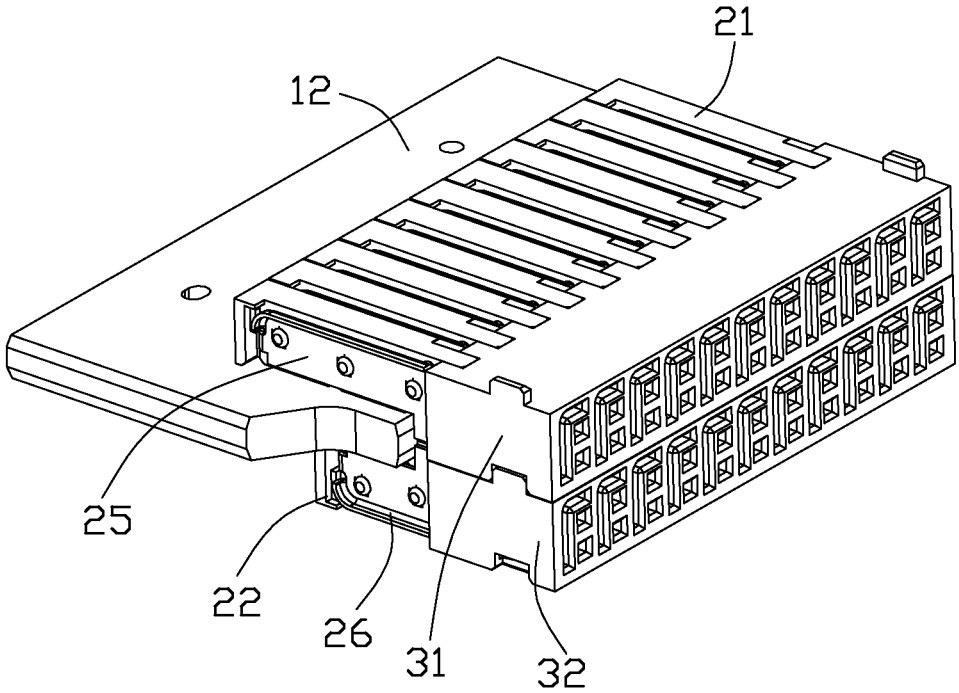
FIG. 4 is a perspective view of the cable assembly shown in FIG. 1 except that a cable, a protecting insulator and conductive covers are removed.
Figure 8:
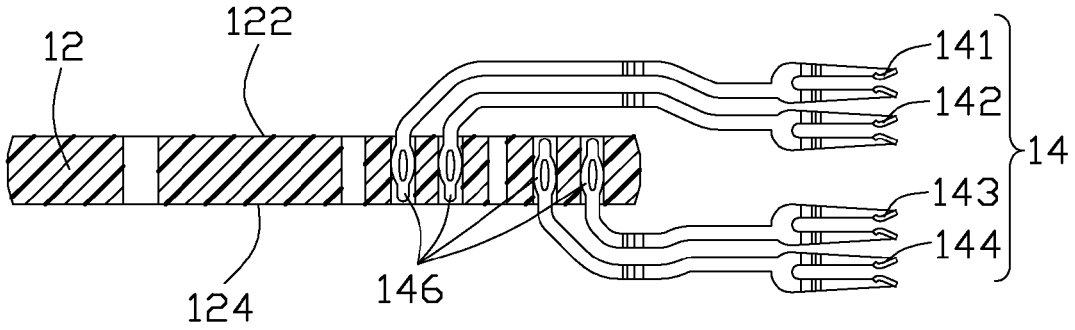
FIG. 8 is a diagram showing the engagement of the conductor and the printed circuit board.

Referring to FIGS. 4, 5 and 8, the printed circuit board 12 defines a plurality of first plated through holes 123 disposed in a rear area receiving the rear portions 146 of the first conductors 141, 142 and a plurality of second plated through holes 123 disposed in a front area receiving the rear portions 146 of the second conductors 143, 144. The first plated through holes 123 corresponding to an upper contact module 21 and the second plated through holes 123 corresponding to a lower contact module 22 are disposed in a line. The printed circuit board 12 defines a pair of holes 126 filled by plastic material of the protecting insulator 102 so that the printed circuit board 12 is firmly secured by the protecting insulator 102.

The electrical connector further comprises a top conductive cover 104 and a bottom conductive cover 106 closed together. The top conductive cover 104 and the bottom conductive cover 106 define a cavity there between and the protecting insulator 102, the printed circuit board 12 and the plurality of upper and lower contact modules 21, 22 are received therein. The top conductive cover 104 forms a protrusion 105 including a rib 109 and two tabs 107. The rib 109 forwardly abuts the first insulator 152 of each upper contact modules 21. The stacked upper contact modules 21 are positioned between the two tabs 107. The bottom conductive cover 106 forms a rib and two tabs (not shown) similar to the top conductive cover 104. The top conductive cover 104 and the lower conductive 106 forms a plurality of block 108 (shown in FIG. 3) for abutting the protecting insulator 102 thereby firmly securing the protecting insulator 102 therein.

The disclosure is illustrative only, changes may be made in detail, especially in matter of shape, size, and arrangement of parts within the principles of the invention.

What is claimed is:

1. A cable assembly comprising a cable and an electrical connector connected to an end of the cable, the electrical connector further comprising:

a printed circuit board having a rear edge connected to the cable and a front edge opposite to the rear edge;

a plurality of upper contact modules stacked along the front edge on a top side of the printed circuit board, each of the upper contact modules having at least one first conductor pairs for transferring signal differential pairs lined along a column perpendicular to the printed circuit board and a first insulator encapsulating a center portion of each first conductor of the first conductor pairs, each first conductor of the first conductor pairs further comprising a front portion for mating with a complementary connector and a rear portion mounted onto the printed circuit board; and a plurality of lower contact modules stacked along the front edge on a bottom side of the printed circuit board, each of the lower contact modules having at least one second conductor pairs for transferring signal differential pairs lined along a column perpendicular to the printed circuit board and a second insulator encapsulating a center portion of each second conductor of the second conductor pairs, each second conductor of the second conductor pairs further comprising a front portion for mating with the same complementary connector and a rear portion mounted onto the printed circuit board.

2. A cable assembly as claimed in claim 1, wherein the electrical connector further comprises a first front housing and a second front housing, the first front housing receiving the front portions of the first conductors of each upper contact modules and engaging with the first insulators, the second front housing receiving the front portions of the second conductors of each lower contact modules and engaging with the second insulators.

3. A cable assembly as claimed in claim 1, wherein the printed circuit board defines a plurality of first plated through holes disposed in a rear area receiving the rear portions of the first conductors and a plurality of second plated through holes disposed in a front area receiving the rear portions of the second conductors.

4. A cable assembly as claimed in claim 3, wherein the first plated through holes corresponding to an upper contact module and the second plated through holes corresponding to a lower contact module are disposed in a line.

5. A cable assembly as claimed in claim 1, wherein the electrical connector further comprises a plurality of conductive plates adjacent each upper contact module, each of the conductive plates having a plurality of front portions for mating with the complementary connector.

6. A cable assembly as claimed in claim 5, wherein the first insulator of each upper contact module defines a recess to receiving the adjacent conductive plate and the conductive plate is fixed to said contact module.

7. A cable assembly as claimed in claim 1, wherein the electrical connector further comprises a protecting insulator over molding the rear edge of the printed circuit board.

8. A cable assembly as claimed in claim 1, wherein the electrical connector further comprises a top conductive cover and a bottom conductive cover closed together and receiving the protecting insulator, the printed circuit board and the plurality of upper and lower contact modules therein.

9. A cable assembly as claimed in claim 8, wherein the top conductive cover forms a rib forwardly abutting the first insulators of each upper contact modules.

10. A cable assembly as claimed in claim 9, wherein the top conductive cover forms two tabs, the stacked upper contact modules being positioned between the two tabs.

11. A cable assembly as claimed in claim 1, wherein each contact module is composed of the insulator and only one pair of conductors.

12. An electrical connector comprising:

a printed circuit board having a front edge defining a plurality of first plated through holes disposed in a rear area and a plurality of second plated through holes disposed in a front area;

a plurality of upper contact modules stacked along the front edge on a top side of the printed circuit board, each of the upper contact module having at least one first conductor pairs for transferring signal differential pairs lined along a column perpendicular to the printed circuit board and a first insulator encapsulating a center portion of each first conductor of the first conductor pairs, each first conductor of the first conductor pairs further comprising a front portion for mating with a complementary connector and a rear portion mounted into corresponding first plated through hole of the printed circuit board; and a plurality of lower contact modules stacked along the front edge on a bottom side of the printed circuit board, each of the lower contact module having at least one second conductor pairs for transferring signal differential pairs lined along a column perpendicular to the printed circuit board and a second insulator encapsulating a center portion of each second conductor of the second conductor pairs, each second conductor of the second conductor pairs further comprising a front portion for mating with the same complementary connector and a rear portion mounted into corresponding second plated through hole of the printed circuit board.

13. An electrical connector according to claim 12, further comprising a top conductive cover and a bottom conductive cover closed together and receiving the protecting insulator, the printed circuit board and the plurality of upper and lower contact modules therein.

14. A cable assembly as claimed in claim 13, wherein the top conductive cover forms a rib forwardly abutting the first insulators of each upper contact modules, and wherein the bottom conductive cover forms a rib forwardly abutting the second insulators of each lower contact.

15. An cable connector assembly comprising:

a printed circuit board defining a front region along a front-to-back direction with thereon opposite first and second surfaces in a vertical direction perpendicular to said front-to-back direction;

a plurality of first contact modules side by side stacked with one another along a transverse direction perpendicular to both said front-to-back direction and said vertical direction, to form a first subassembly essentially located upon the first surface, each of said first contact modules including a first insulator with a stepped structure along an edge to receive a portion of said front region of the printed circuit board in the vertical direction, a first differential pair embedded in the first insulator, and a first ground contact attached to the first insulator; and a plurality of second contact modules side by side stacked with one another along the transverse direction to form a second subassembly essentially located upon the second surface, each of said second contact modules including a second insulator with another stepped structure along another edge to receive a remaining portion of said front region of the printed circuit board in the vertical direction, a second differential pair embedded in the second insulator, and a second ground contact attached to the second insulator; wherein a front portion of said first subassembly and that of said second subassembly are expanded toward each other in the vertical direction and above the corresponding first surface and second surface of the printed circuit board for intimate confrontation with each other.

16. The cable connector assembly as claimed in claim 15, further including first and second front housings stacked with each other in the vertical direction in which the front portion of the first subassembly and that of the second subassembly are received.

17. The cable connector assembly as claimed in claim 16, wherein the first and second front housing include mutually interengaging devices thereof so as to restrain relative therebewteen in the front-to-back direction.

18. The cable connector assembly as claimed in claim 15, wherein rearwardly extending tails of the first differential pairs are longer than and terminated behind the rearwardly extending tails of the second differential pairs, and the printed circuit board defines a plurality of rows of through holes to receive corresponding tails of the first different pairs and those of the second differential pairs, respectively, in a compliant manner.

19. The cable connector assembly as claimed in claim 15, further including a first transverse grounding plate around a rear side of the first subassembly so as to allow the corresponding first ground contacts to commonly contact therewith, and a second transverse grounding plate around a rear side of the second subassembly so as to allow the corresponding second ground contacts to commonly contact therewith.

20. The cable connector assemble as claimed in claim 19, wherein the first transverse grounding plate defines a plurality of tail ends lying in a first vertical plane defined by the transverse direction and the vertical direction while tail ends of the first different pairs lie in a second vertical plane defined by the front-to-back direction and said vertical direction.

* * * * *